United States Patent [19]

DeMand

[11] 3,973,515

[45] Aug. 10, 1976

[54] TABLET BINDING MACHINE

[75] Inventor: John DeMand, Topeka, Kans.

[73] Assignee: Wilson Jones Company, Chicago, Ill.

[22] Filed: Aug. 19, 1975

[21] Appl. No.: 605,851

[52] U.S. Cl. ..... 118/202; 118/503; 118/242; 11/1 AD; 11/1 B; 74/25; 74/89.17

[51] Int. Cl.[2] ..... B05C 1/02; B05C 13/02

[58] Field of Search ..... 11/1 R, 1 A, 1 AD, 1 AC, 11/1 B, 4; 281/21; 402/63, 67, 68; 100/288; 74/25, 27, 89.13, 89.17; 156/447 B; 118/242, 202, 503

[56] References Cited

UNITED STATES PATENTS

| | | | |
|---|---|---|---|
| 1,720,680 | 7/1929 | Kleinberg | 11/4 X |
| 3,261,044 | 7/1966 | Hoff | 11/1 AD |
| 3,460,173 | 8/1969 | Stvertz | 11/1 B |
| 3,516,387 | 6/1970 | Windsor | 118/242 X |
| 3,757,736 | 9/1973 | Anderson | 118/202 X |

FOREIGN PATENTS OR APPLICATIONS

| | | | |
|---|---|---|---|
| 328,449 | 3/1958 | Switzerland | 11/1 AD |
| 934,823 | 8/1963 | United Kingdom | 11/1 AD |
| 328,449 | 3/1958 | Switzerland | 11/1 AD |

*Primary Examiner*—Lawrence Charles
*Attorney, Agent, or Firm*—Pennie & Edmonds

[57] ABSTRACT

A binding machine for binding sheets in a stack by the application of glue along one edge of the sheets. The binding machine incorporates a manually operated clamp mechanism to hold the sheets together with sufficient compression to maintain the proper alignment of the sheets for the application of glue to the sheet edge.

20 Claims, 7 Drawing Figures

TABLET BINDING MACHINE

BACKGROUND OF THE INVENTION

Binding machines are used for binding together sheets in a stack by the application of glue, with or without the addition of tape, along one edge of the sheets being bound. These machines have typically included a mechanism for clamping the sheets firmly together for binding and moving sheets to a binding position where glue is applied to the exposed edges of the clamped sheets. In applying the glue an applicator usually having a roller in contact with the exposed edge is moved linearly the entire length of the edge. To obtain this movement these binding machines have employed complex power-driven mechanisms including gear trains and sprocket and chain drives which are expensive to manufacture and to operate. Where a hot melt glue is applied in its solid form, the clamped sheets must be moved from a position where the glue is applied to another position where the glue can be heated to effect the binding of the sheets. This requires additional time on the part of the operator in the binding process and extra moving mechanisms, increasing the costs of the machine.

The clamping devices in these machines for holding the sheets in proper alignment have been rather complex, requiring several operative steps to insure that the sheets are clamped with sufficient compression. These devices employ a mechanism for moving a clamp bar adjacent to sheets being bound and a detent means for preventing the clamp bar from moving away from the sheets once it has been moved adjacent thereto. A second clamp means such as an eccentric, is incorporated to further press the sheets to obtain the compression needed for the binding operation. This two-step mechanism increases the complexity in operation and ultimately the cost of manufacture of the binding machine.

SUMMARY OF THE INVENTION

The present invention provides means for binding sheets in a stack by the application of a hot melt glue to one edge of the sheets in a simple and efficient manually operated device. The machine incorporates means for moving the sheets to be bound from a loading position to a binding position by manual operation of exposed knobs where the length of travel for the knobs corresponds to the distance between the two positions. In the loading position the sheets to be bound are clamped together by rotating a clamp knob which moves a clamp bar into contact with the sheets imparting sufficient compression to hold the sheets in alignment for the binding operation. The clamped sheets are then moved to a binding position where the edges of the sheets are exposed to a glue applicator. The glue applicator is slidably fixed on tracks beneath the sheet edges and has projecting therefrom a traverse knob which allows the glue applicator to be manually moved beneath the exposed edge of the sheets for applying the glue. The glue is allowed to dry after which the clamped sheets are returned to the loading position for withdrawal of the bound sheets from the machine. Withdrawal is accomplished by a simple manual release mechanism which allows the clamp bar to be disengaged from the sheets.

In a preferred embodiment, the means for clamping the sheets together include a clamp bar which rides on two rods extending from a backplate, which provides a back surface against which the sheets are clamped. The rods are rack gears which engage pinion gears rotatably secured to the clamp bar such that rotation of the pinion gears moves the clamp bar toward and away from the backplate in the path defined by the rods. A manually rotatably clamp knob is connected to the pinion gear through bevel gears for transferring the rotational motion imparted to the clamp knob to corresponding motion in the pinion gears. In this manner, turning in the clamp knob will result in the rotation of the pinion gears to move the clamp bar toward the back plate. This mechanism includes a one way clutch preventing rotation of the clamp knob in a direction which will cause the clamp bar to move away from the back plate to disengage the sheets. A release mechanism cooperates with the one way clutch allowing the clutch to be disengaged by simply pulling the clamp knob away from the clamp bar. In this manner, the clamp bar is disengaged from the bound sheets facilitating withdrawal of the work from the machine.

DETAILED DESCRIPTION OF THE PREFERRED EMBODIMENT

Figure 1:
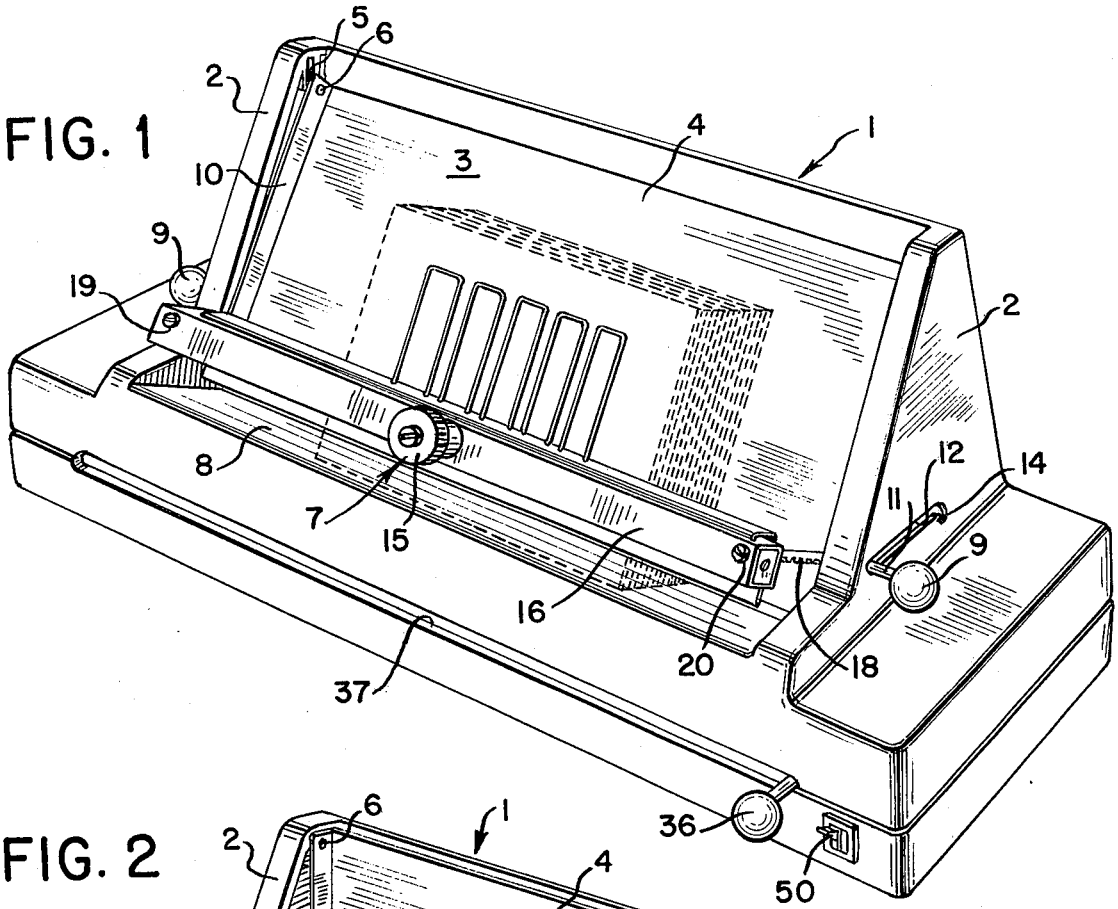
FIG. 1 shows a perspective view of the binding machine in a loading position.
Figure 2:
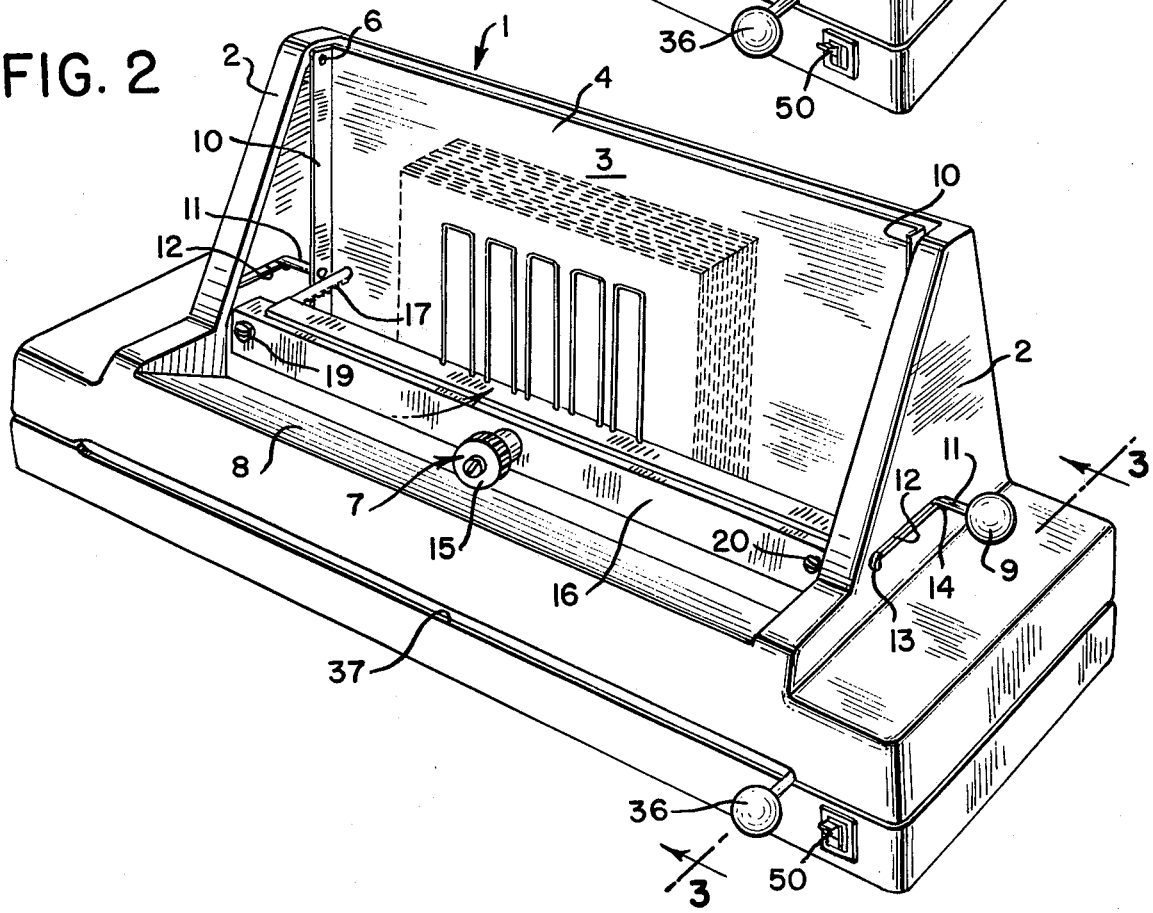
FIG. 2 shows a perspective view of the binding machine in a binding position.
Figure 3:
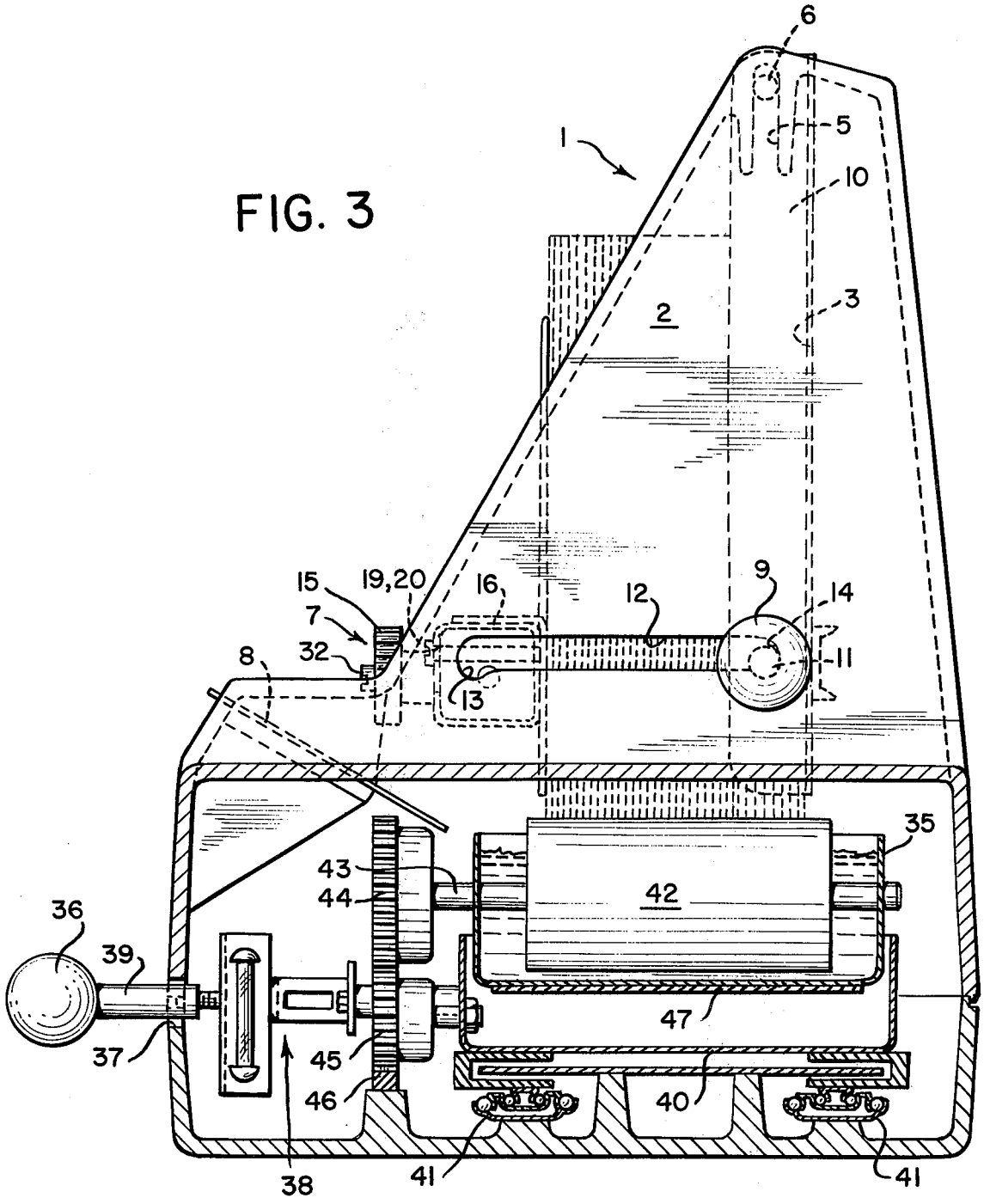
FIG. 3 is a cross-sectional view of the binding machine in the binding position taken along lines 3—3 of FIG. 2.

A binding machine 1 as shown in FIG. 1 has a housing 2 to which a backplate 3 is pivotally attached at its top portion 4. At an upper portion of the housing there are provided two vertical slots 5 one at each end for engagement by bosses 6 which extend from the top portion 4 of backplate 3. At the bottom portion of the backplate 3 there is attached an adjustable clamp assembly 7 which provides a means for fixing the sheets to be bound against the backplate 3. Beneath the back plate 3 on the housing when the machine is in the loading position there is provided a binding plateform 8. With this configuration the backplate 3 can be moved from a loading position as shown in FIG. 1 to a binding position shown in FIG. 2. In the loading position the sheets to be bound are placed against the backplate 3 with the edge to be bound jogged in alignment on the binding platform 8. In this loading position the clamping assembly 7 is adjusted to clamp the sheets firmly against the backplate 3. From this position the backplate 3 with the sheets clamped thereto can be moved to the binding position as shown in FIG. 2. In the binding position the edges to be bound are exposed to a mechanism within the housing for applying the glue to these edges for binding the sheets together.

To move the plate 3 from the loading position to the binding position there are provided shift handles 9 attached to a flange 10 each edge of the backplate 3.

Each shift handle 9 is connected to the flange 10 by a shift handle shaft 11. The shift handle shaft moves within a slot 12 in each end of the housing 2. At each end of the slot 12 there are enlarged portions 13, 14 which correspond respectively to the loading position and the binding position of the backplate 3. The enlarged portions are shaped to engage the shift handle shaft 11 at each position in a manner requiring the shift handle to be raised slightly before being moved through the slot. This configuration allows the backplate 3 to come to rest at either the loading or binding position until it is desired to move the backplate again by operation of the shift handle 9.

Figure 4:
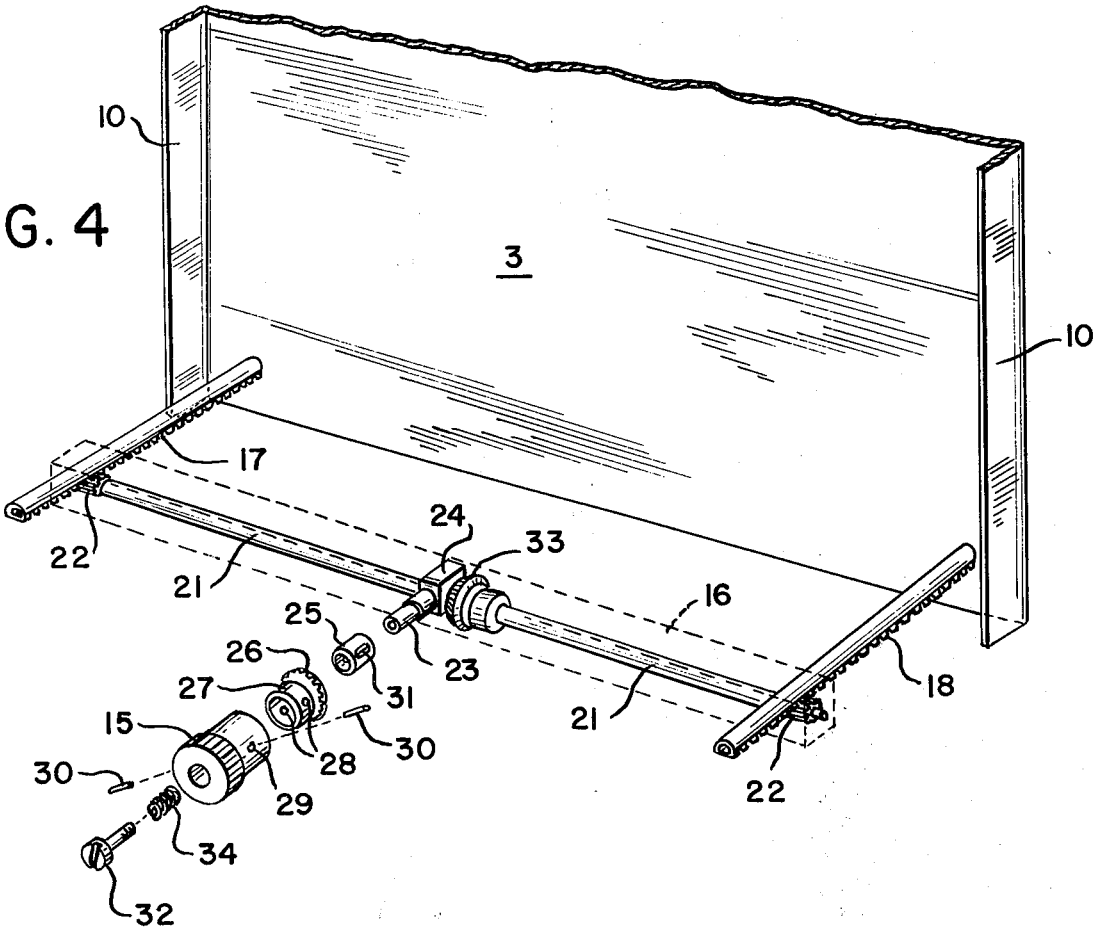
FIG. 4 is an exploded view of the clamp mechanism shown in FIGS. 1 and 2.

Means are provided for clamping the clamp assembly against the sheets by simply turning a clamp knob 15. In FIG. 4 there is shown an exploded view of the clamp assembly demonstrating the interaction of the elements to move the clamp assembly against the sheets for clamping them into position against the backplate 3. This assembly includes a clamp bar 16 which extends substantially the entire length of the backplate 3. Two rack gear rods 17, 18 extend perpendicularly from the lower portion of the backplate 3 and are engaged by the clamp bar 16. The clamp bar 16 defines two apertures 19, 20 which allow it to be slidably engaged with the rack gear rods 17, 18. Within the clamp bar 16 there is rotatably secured a pinion shaft 21 having at each end thereof a pinion gear 22. The location of the apertures 19, 20 for the rack gear rods 17, 18 is such that the pinion gears will always be maintained in contact with the rack gear as the clamp bar is moved toward and away from the backplate.

Near the center of the pinion shaft there is attached a knob shaft 23 to a block 24 which is rotatably fixed to the pinion shaft 21. A one way clutch bearing 25 is fixed in the axial direction coaxially with the knob shaft 23. A bevel gear 26 is rotatably fixed over the one way clutch 23 and has a gear shank 27 having pin holes 28 extending transversely to the axis of the bevel gear. The clamp knob 15 also defines pin holes 29 which register with the pin holes 28 in the bevel gear shank. Pins 30 are provided to extend through the pin holes 28 and 29 in the clamp knob 15 and bevel gear shank 27 respectively to hold the bevel gear 26 relative to the clamp knob in both the axial and rotational directions. A groove 31 is provided in the surface of the one way clutch 25 to register with the pin holes 28 and 29. The pins are of such a length that they extend through both the clamp knob 15, the bevel gear shank 27, and into the groove of the one way clutch 25.

Figure 5:
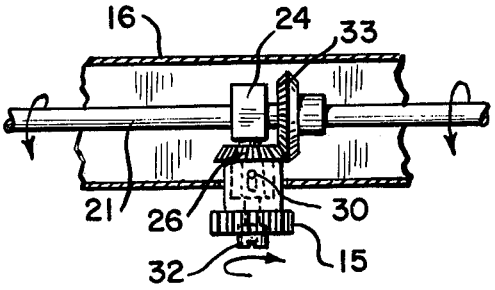
FIG. 5 is a plan view of the clamp mechanism in an engaged disposition.

The one way clutch, bevel gear, and clamp knob are maintained on the knob shaft 23 by a release button bolt 32 which threadably engages a threaded end portion on the knob shaft 23. A helical spring 34 circumscribes the shank portion of the release button and biases the bevel gear 26 toward the backplate 3. Adjacent the knob shank 21 is a pinion bevel gear 33 secured coaxially on the pinion shaft 21 which cooperates with the bevel gear 26. With this configuration the bevel gear 26 will be maintained in contact with the pinion bevel gear 33 because of the bias imparted in that direction by the spring 34, as shown in FIG. 5.

As the clamp knob 15 is rotated in the clockwise direction, the rotation of the bevel gears will cause the pinion gear to rotate toward the backplate 3 along the rack gear rod 16. This rotation and movement toward the blackplate 3, causes a corresponding movement of the clamp bar 16 toward the backplate 3 for clamping the sheets into position.

Figure 6:
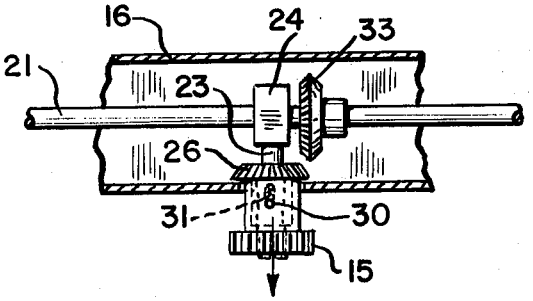
FIG. 6 shows the clamp mechanism of FIG. 5 in a disengaged disposition.

The one way clutch has an outer race which allows rotation only in the clockwise direction preventing rotation in the counter-clockwise direction. Because the pins 30 engage the slots in the one way clutch bearing 25, and the pin holes 29 in the clamp knob, rotating the clamp knob is prevented in the counter-clockwise direction. Because the one way clutch only allows rotation in the clockwise direction, rotation in the opposite direction for withdrawing the clamp bar from engagement from these sheets cannot be accomplished. The only way disengagement can be obtained is by pulling on clamp knob 15 in an axial direction away from the backplate 3 overcoming the bias of spring 34. As shown in FIG. 6, this will cause the bevel gear 26 to disengage the pinion bevel gear allowing the pinion shaft to rotate in the opposite direction away from backplate 3.

The axial movement of clamp knob 15 and bevel gear 26 is not affected by the one way clutch bearing. Movement of the pin 28 axially by the clamp knob effects a similar movement of the bevel gear relative to the clutch bearing because the pins travel in the axial slots defined in the outer race of the clutch bearing 25. With this mechanism, a simple and efficient method is provided for clamping the sheets into position. Only rotation of the clamp knob is needed to drive the clamp bar adjacent the sheets and to compress the sheets for binding. The sheets can be clamped without fear of their becoming inadvertentally unclamped by rotation in the opposite direction.

Once the paper is clamped in the loading position the shift handles are moved to the rear slot portion 14 exposing the edge of the sheets to the internal parts of the machine for the application of the glue. In the binding position the sheets are located above a glue pot 35. Attached to the glue pot is handle 36 which extends through slot 37 in the front of the housing for moving the glue pot the entire length of the sheets being bound. As more clearly seen in FIG. 7, the handle is connected to a bracket 38 by handle shaft 39. The bracket is in turn fixed to the glue pot housing 40. The glue pot housing 40 is slidably secured to ballbearing slidetracks 41 which extend substantially the entire length of the housing. This allows the glue pot to be easily moved in a fixed direction beneath the sheets being bound for application of the glue.

The glue pot 35 has a roller 42 secured rotatably thereto by roller shaft 43. As the glue pot 35 traverses beneath the sheets being bound the roller 42 picks up the glue in the glue pot and rolls it on to the sheets being bound as it contacts the edges. The roller shaft 43 is fixed to a roller gear 44. Engaged with the roller 44 is an idler gear 45 which in turn engages a glue pot gear rack 46. A glue pot gear rack 46 extends substantially the entire length of the housing parallel with the ballbearing slidetracks 41. With this gear configuration movement of the gear housing at any speed will guarantee a fixed relationship between the speed of the roller surface relative to the sheets being bound. Thus, regardless of the speed with which the glue pot housing is being moved beneath the sheets the roller will always apply the same amount of glue to the edges being bound.

Where a hot melt glue is used, the glue pot is heated by a resistance coil connected to the bottom of the pot. The coil 47 is connected to a power cable 48 at bracket 35 by quick disconnect plugs 49. The other end of the power cable is connected to a switch 50 which in turn is connected to the power source (not shown). With this configuration the glue can be heated merely by the operation of switch 50 which is exposed in front of the housing as shown in FIGS. 1 and 2.

Figure 7:
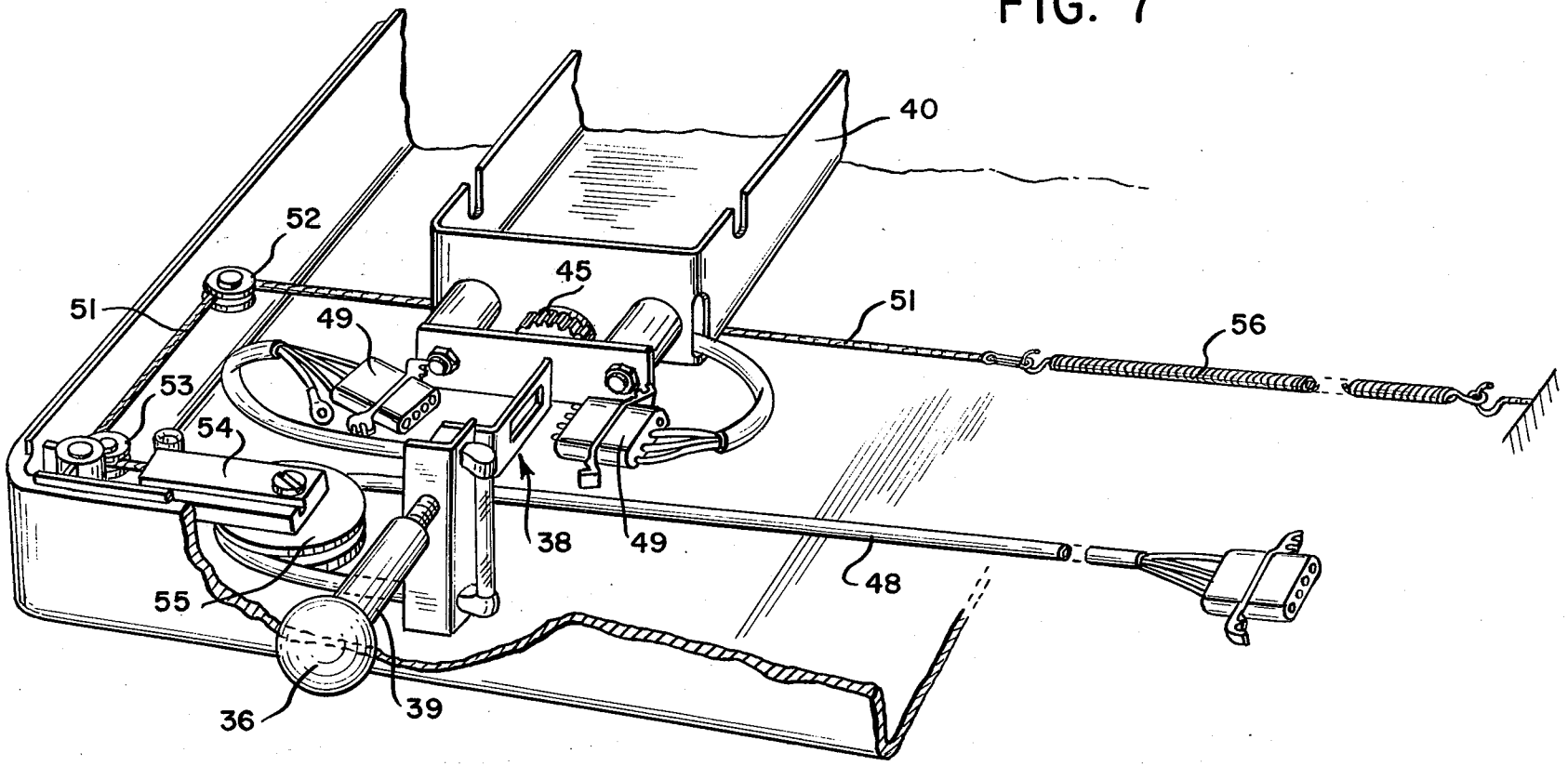
FIG. 7 is a partial view of the internal elements of the binding mechanism.

The power cable is maintained in a taut disposition by series of pulleys and cables to insure that the cable will not become entangled with the other elements of the binding apparatus. As shown in FIG. 7, a cable 51 is reeved about two pulleys 52 and 53 and connected to a power cable pully bracket 54. A power cable pulley 55 is rotatably connected to the bracket 54 and the power cable 48 is reeved through the power pulley 55 and fixed to the bracket 38. The other end of the cable 51 is attached to a spring 56. The other end of the spring 56 is secured to the housing. In this manner, movement of the handle 36 in a transerse direction to the right will cause the spring 50 to be extended as the power cable 48 is pulled through the power cable pulley 55, thus, always maintaining the power cable in a taut disposition.

In the operation of the machine the shift handles are moved to the loading position and rested in slot portion 13. In this position, the sheets are then loaded against the backplate 3 with the edge to be bound resting on binding platform 8. In this loading position, the sheets should be jogged on the binding platform 8 to insure that they are propertly aligned at the edge being bound. The sheets are then clamped in place by simply turning the clamp knob in the clockwise direction until the clamp bar is secured against the sheets thereby clamping them firmly against the backplate 3. After the sheets have been clamped in this position, the shift handles 9 are then moved rearwardly toward slot portion 14 into the binding position. At this position the edge to be bound is now exposed to the glue pot for applying glue and binding the sheets together. In the binding position the handle 36 is moved across the front of the housing. This movement causes the roller in the glue pot to engage the sheets being bound and to apply the glue to the exposed edge. Depending on the thickness of the sheets the glue pot can be moved several passes beneath the sheets to achieve the desired level of glue onto the edge being bound. After the desired amount of glue is applied the sheets are maintained in the binding position a sufficient time to allow the glue to dry and secure the sheets together. After this period is passed, the shift handles are moved back to the loading position where the sheets can be withdrawn. To withdraw the sheets, the clamp bar is merely pulled in the axial direction away from the backplate 3. Pulling on clamp bar in this manner will move the clamp bar away from engagement with the sheets allowing them to be withdrawn from the machine.

The machine described above allows the stacked sheets to be bound in a simple, easy and efficient manner requiring only manual traversing the handles within the slots. Further, the clamp mechanism is one which insures that there is no inadvertent disengagement of the clamp bar against the sheets. The device described above is one which is easy to operate, easy to maintain and can be produced at significantly lower cost than machines which have heretofor existed.

I claim:

1. An apparatus for binding sheets of paper in a stack along one edge of the stack comprising:

a. an applicator for applying adhesive to said one edge;

b. a back plate against which the sheets are clamped and held in the clamped position while the adhesive is applied, and c. a clamp means to hold the sheets together with sufficient compression for maintaining the sheets in alignment against said back plate including:

i. a rotatable knob moving means for driving said clamp bar toward the back plate adjacent said sheets and for causing said clamp bar to be pressed against said sheets with sufficient pressure to maintain the sheets in alignment, ii. a release means for disengaging the clamp bar from the sheets allowing the sheets to be withdrawn from the binding machine, and iii. a holding means for holding the clamp bar in the clamped position until said clamp bar is released by said release means.

2. The apparatus according to claim 1 wherein said holding means is a one way clutch cooperating with said rotatable knob moving means to prevent rotation in a direction which will allow the clamp bar to be moved away from the sheets being bound.

3. The apparatus acording to claim 2 wherein said moving means includes a clamp knob exposed for manual rotation, said clamping mechanism further comprises rods having a rack gear thereon extending substantially perpendicular from the back plate, said clamp bar having pinion gears at each end of the pinion shaft for engagement with the rack gear on said rods, and engagement means for connecting said clamp knob with said pinion shaft for transferring the rotational motion of the clamp knob to rotational motion of the pinion shaft such that rotation of the knob causes the shaft to move along the rack gear toward the sheets being bound.

4. The apparatus according to claim 3 wherein said engagement means includes a pinion bevel gear on said pinion shaft and a bevel gear connected to said knob and in engageable relationship with the pinion bevel gear.

5. The apparatus accorrding to claim 4 wherein said one way clutch is connected to said clamp knob such that said knob can only be rotated in one direction.

6. The apparatus according to claim 5 wherein said release mechanism includes a spring biasing means for biasing the knob bevel gear against the pinion shaft bevel gear and means for overcoming said bias for allowing disengagement of said bevel gears such that the pinion shaft will rotate in a direction away from the sheets being bound.

7. The apparatus according to claim 6 wherein said pinion shaft has a knob shaft rotatably attached thereto on which is secured said one way clutch, said knob bevel gear and said knob, said knob bevel gear being secured to said clamp knob by pin means extending through the clamp knob and the shaft of the bevel gear, said one way clutch having axial slot means for engagement by said pin means, and said slot means cooperating with said pin means to allow rotational movement of the knob bevel gear in one direction and axial movement of the knob bevel gear toward and away from the pinion bevel gear but preventing rotational movement in the opposite direction.

8. The apparatus according to claim 7 wherein said knob and bevel gear are secured to the knob shaft by a bolt having a button at one end of the bolt, said spring means includes a helical spring coiled about the axis of the button shaft between the clamp knob and the button.

9. The apparatus according to claim 8 wherein said pinion shaft is rotably secured to the clamp bar and said clamp bar defining aperatures for slidably engaging the rack gear rod and located relative the pinion gears to maintain the pinion gear in contact with the rack gear.

10. A binding machine for binding together sheets in a stack by the application of glue to one edge of the stack comprising:

a. A back plate, b. A clamp means for clamping sheets against the back plate, c. Means for manually moving the plate from a loading position to a binding position, d. A glue pot slideably fixed beneath the back plate in the binding position, said glue pot having an applicator for applying glue to the edges of the sheets said glue pot being fixed to an exposed knob for manually moving said glue pot in a linear path corresponding to the linear movement of the knob.

11. The apparatus according to claim 10 wherein said clamp means includes a rotating knob connected to a clamp bar moving means for moving the clamp bar toward and away from the sheets to be bound and a release mechanism for disengaging the clamp bar.

12. The apparatus according to claim 11 wherein said glue pot is secured on a slidable ball bearing track beneath the sheets in a binding position, said glue pot is heated by a resistance coil such that a hot melt glue can be used in binding the sheets, gear means are connected to a roller in the glue pot for rotating the roller at a fixed rate relative to the speed of the glue pot such that the surface speed of the roller equals the lateral speed of the glue pot and knob means are attached to the back plate and exposed from manually moving the back plate from a loading position to the binding position.

13. The apparatus according to claim 11 wherein said clamp means includes a one way clutch cooperating said clamp knob to prevent rotation of the knob in a direction which will allow the clamp bar to be moved away from the sheets being bound.

14. The apparatus acording to claim 13 wherein said moving means includes a clamp knob exposed for manual rotation, said clamping mechanism further comprises rods having a rack gear thereon extending substantially perpendicular from the back plate, said clamp bar having pinion gears at each end of the pinion shaft for engagement with the rack gear on said rods, and engagement means for connecting said clamp knob with said pinion shaft for transferring the rotational motion of the clamp knob to rotational motion of the pinion shaft such that rotation of the knob causes the shaft to move along the rack gear toward the sheets being bound.

15. The apparatus according to claim 14 wherein said engagement means includes a pinion bevel gear on said pinion shaft and a bevel gear connected to said knob and in engageable relationship with the pinion bevel gear.

16. The apparatus according to claim 15 wherein said one way clutch is connected to said clamp knob such that said knob can only be rotated in one direction.

17. The apparatus according to claim 16 wherein said release mechanism includes a spring biasing means for biasing the knob bevel gear against the pinion shaft bevel gear and means for overcoming said bias for allowing disengagement of said bevel gears such that the pinion shaft will rotate in a direction away from the sheets being bound.

18. The apparatus according to claim 17 wherein said pinion shaft has a knob shaft rotatably attached thereto on which is secured said one way clutch, said knob bevel gear and said knob, said knob bevel gear being secured to said clamp knob by pin means extending through the clamp knob and the shaft of the bevel gear, said one way clutch having axial slot means for engagement by said pin means, said slot means cooperating with said pin means to allow rotational movement of the knob bevel gear in one direction and axial movement of the knob bevel gear toward and away from the pinion bevel gear but preventing rotational movement in the opposite direction.

19. The apparatus according to claim 18, wherein said knob and bevel gear are secured to the knob shaft by a bolt having a button at one end of the bolt, said spring means includes a helical spring coiled about the axis of the button shaft between the clamp knob and the button.

20. The apparatus according to claim 19 wherein said pinion shaft is rotably secured to the clamp bar and said clamp bar defining aperatures for slidably engaging the rack gear rod and located relative the pinion gears to maintain the pinion gear in contact with the rack gear.

* * * * *

UNITED STATES PATENT AND TRADEMARK OFFICE

CERTIFICATE OF CORRECTION

PATENT NO. : 3,973,515

DATED : August 10, 1976

INVENTOR(S) : John DeMand

It is certified that error appears in the above-identified patent and that said Letters Patent are hereby corrected as shown below:

Column 7, lines 18 and 19, "sheets said glue" should read --sheets and said glue--;

Column 8, line 31, "means, said slot means" should read --means, and said slot means--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*